US006751885B2

(12) United States Patent
Franzoni et al.

(10) Patent No.: US 6,751,885 B2
(45) Date of Patent: Jun. 22, 2004

(54) VERTICAL KILN

(75) Inventors: Luigi Franzoni, Imola (IT); Valdo Marini, Alfonsine (IT)

(73) Assignee: Cefla Soc. Coop. A.R.L. (IT)

( * ) Notice: Subject to any disclaimer, the term of this patent is extended or adjusted under 35 U.S.C. 154(b) by 0 days.

(21) Appl. No.: 10/239,403

(22) PCT Filed: Mar. 15, 2001

(86) PCT No.: PCT/EP01/02935

§ 371 (c)(1),
(2), (4) Date: Sep. 23, 2002

(87) PCT Pub. No.: WO01/73364

PCT Pub. Date: Oct. 4, 2001

(65) Prior Publication Data

US 2003/0079364 A1 May 1, 2003

(30) Foreign Application Priority Data

Mar. 24, 2000 (IT) ..... GE2000A0044

(51) Int. Cl.[7] ..... F26B 21/06

(52) U.S. Cl. ..... 34/77; 34/87; 34/216; 34/236

(58) Field of Search ..... 34/76, 77, 87, 34/92, 209, 210, 215, 216, 217, 236, 396, 518

(56) References Cited

U.S. PATENT DOCUMENTS

| | | | | | |
|---|---|---|---|---|---|
| 3,680,219 | A | * | 8/1972 | Koch | 34/396 |
| 3,896,559 | A | * | 7/1975 | Martin | 34/662 |
| 4,106,215 | A | * | 8/1978 | Rosen | 34/217 |
| 4,182,048 | A | * | 1/1980 | Wolfe et al. | 34/396 |
| 4,261,110 | A | * | 4/1981 | Northway et al. | 34/396 |
| 4,663,860 | A | * | 5/1987 | Beall | 34/396 |
| 2002/0000050 | A1 | * | 1/2002 | Goldack | 34/444 |

FOREIGN PATENT DOCUMENTS

| | | | | | |
|---|---|---|---|---|---|
| DE | 36 32 740 | A1 | * | 5/1987 | F26B/15/14 |
| FR | 2 429 735 | A | * | 2/1980 | B65G/65/00 |

OTHER PUBLICATIONS

Ferraro, Graziano. "Dryer in Vertical Configuration For Treating Objects, Particularly Panels, Boards and Sheets, Which Are Coated . . . " English Translation of German Patent No. 36 32 740 A1. The Ralph McElroy Translation Company. Aug. 2002.*

* cited by examiner

*Primary Examiner*—Henry Bennett
*Assistant Examiner*—Andrea M. Ragonese
(74) *Attorney, Agent, or Firm*—Stites & Harbison PLLC; Marvin Petry

(57) ABSTRACT

Trays are provided with identical vertical spacers which enable the trays to be stacked on top of each other in a centered way, with a suitable or appropriate spacing between them, and enable the various adjacent stacks of trays to be raised and lowered in steps, by an elevating and lowering system which acts only on the bottom tray of each stack. The sides of the stacks of trays of the kiln are thus free and can be engaged by conveyors for the translation of the trays between the stacks, both in a normal operating cycle and in a short operating cycle. However, the lower translation conveyors, which transfer the trays from the stack with an unloading station to that with a loading station, are positioned in the conventional way, i.e., under the stacks of trays and transversely with respect to the trays.

35 Claims, 12 Drawing Sheets

V
4
25
119
19
18
8
13
12
11
9
110
10
20
21
22

V
V
V
4
4
4
25
3
119
19
3
23
24
23
18
8
10
7
12
13
11
9
27
29
5
28
7
110
20
21
22
15
17
16
T (K1-K2)

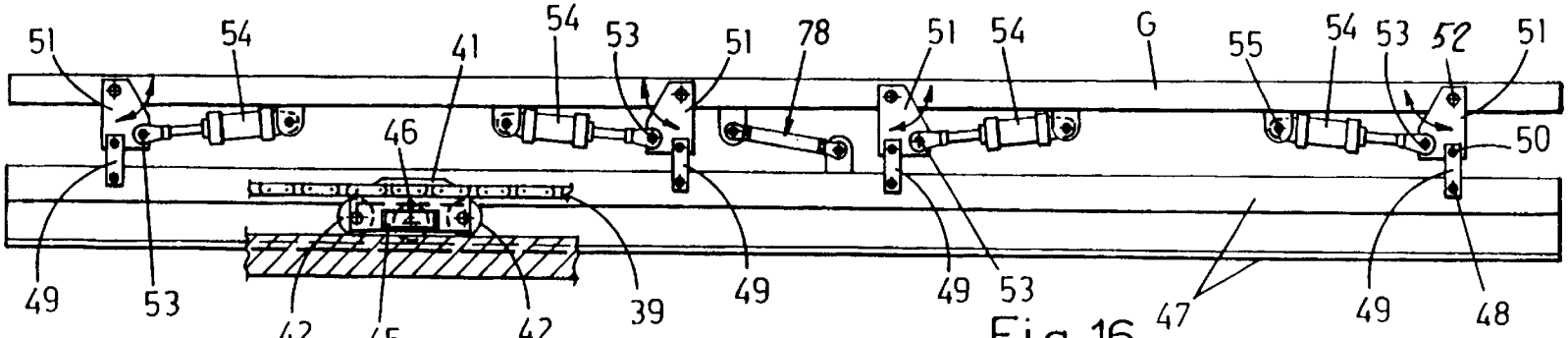
Fig. 16
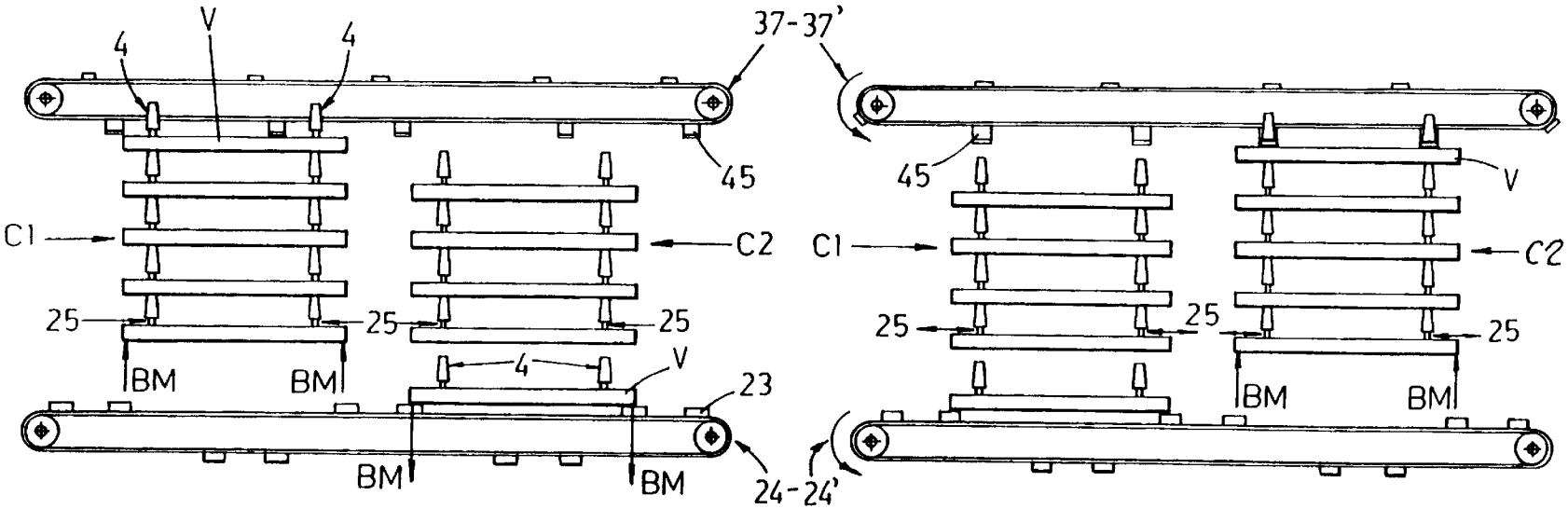
Fig. 21
Fig. 20

VERTICAL KILN

FIELD OF THE INVENTION

The invention relates to vertical kilns or dryers, used for drying products such as panels or articles of timber or other material, for example after painting, coloring, impregnation or other types of operation. Equipment of this type contains, within a parallelepipedal heating chamber, two or more adjacent stacks of horizontal trays, which are carried by an elevating and lowering system and by a translating device along a zig-zag path which usually starts at the base of the first stack with an ascending movement, at the point where the trays are loaded with the articles to be dried, and which terminates at the base of the last stack with a descending movement, at the point where the dried articles are unloaded from the trays. A final translating device then transfer the empty trays directly from the lower part of the last stack to the lower part of the first stack, thus forming the path of the trays into a closed loop.

To gain a clearer idea of the problems encountered in vertical kilns of the known type, reference is made to FIGS. 1 and 2 which show, schematically and in a theoretical way, a known kiln with two stacks of trays, seen from the side and from the front of one of the stacks respectively. The trays V of the stacks C1 and C2 are, for example, of rectangular shape and have their short sides resting on brackets M carried by opposite vertical pairs of chain conveyors T1 and T2, which are synchronized with each other and provided with an intermittent and opposing motion, to elevate the trays in the stack C1 and lower those in the stack C2. The brackets of the conveyors T1 and T2 are aligned horizontally with each other, and thus when a tray reaches the top of the stack C1 it can be transferred to the top of the stack C2 by means of horizontal chain conveyors T3, parallel to the path of translation, which have teeth D which push the long side of the tray and transfer it from the brackets of T1 to the coplanar brackets of T2.

The tray which cyclically reaches the bottom of the stack C2 first has the dried articles unloaded from it at a station K2 and is then placed on a horizontal chain conveyor T4 which transfers the empty tray at the correct time from C2 to C1, where means operate at the station K1 to load new articles for drying on to the empty tray. The stages of transfer of the trays between the two stacks take place at the same time as the stages of loading and unloading other trays at the stations K1 and K2.

In a known kiln of this type or of a similar type, the following drawbacks are encountered. The presence of the chains of the conveyors T1 and T2 throughout the height of the stacks C1 and C2, and especially the presence of the conveyors T3 located transversely and above the trays of C1 and C2, can cause dirt to fall on the articles contained in the trays, thus inevitably leading to the rejection of products.

The whole of the weight of the trays contained in the stacks C1 and C2 is discharged on to the upper return shafts of the conveyors T1 and T2, and these shafts must therefore be supported by a frame which has suitable load-bearing characteristics, and is therefore relatively heavy, bulky and expensive.

As shown in FIG. 2, the conveyors T1 and T2 have a considerable depth, and make it necessary to provide means of circulating the hot drying air at a considerable distance from the ends of the trays located in the stacks C1 and C2, with markedly adverse effects on the functionality of these means.

The chains which form the elevating and lowering conveyors T1, T2 are mechanisms which, although very reliable from the technological point of view, are expensive and require periodic maintenance.

When the known conveyors T1 and T2 for elevating and lowering the trays are used, it is very difficult to apply the method of short-cycle movement of the trays, described in Italian patent application No. BO 99A 000089 in the name of the applicant, to which reference will generally be made, according to which the trays are elevated by at least one step from the loading station and then the trays are translated and lowered directly to the unloading station from which the trays are returned towards the loading station with the usual lower translating means. All the other trays not included in the short cycle must remain stationary.

The invention is designed to overcome these and other drawbacks of the vertical kilns according to the known art, by the following idea for a solution.

The trays are provided at their corners, for example at the ends of the long sides, with vertical spacers, projecting upwards for example, which are identical and enable stacks to be formed in which the trays rest on one another and are spaced apart with a desired interval. The spacers are preferably such that their upper ends interact with suitable seats formed on the bases of the trays lying above, in such a way that the stacked trays are perfectly centered with respect to each other. In this case, the rising and descending movement of the trays in the consecutive stacks of the kiln is achieved by means of elevating and lowering devices which act on the bottom tray of each stack, grippers being provided in the stacks with ascending movement to retain the bottom tray of these stacks in position, to enable the ascending means to return to the low position for the repetition of a new cycle. In the stacks with a descending movement, similar grippers are provided to keep the tray next to the bottom held in the high position, while the elevating and lowering device supports the bottom trays of the stacks on the lower translating device such as a conveyor. The trays, held by the gripper, are at such a height that they do not interfere with the lower tray translated by the lower translating device. For the upper translation of the trays from the top of one stack to that of the adjacent stack, it is possible to provide chain conveyors parallel to the short sides of the trays, outside the stacks of the trays, and it is possible to associate these conveyors with means which, at the appropriate time, slightly raise the trays to be translated and which then translate the trays and deposit them on the trays of the receiving stack.

Clearly, the new solution makes it possible

- to eliminate the conventional elevating and lowering chain conveyors T1 and T2 (FIGS. 1 and 2) and to overcome all the drawbacks arising from the use of such conveyors;
- to place the conveyors for translating the trays from one stack to the adjacent stack outside the plan dimensions of the stack of trays and thus to eliminate the drawbacks arising from the use of the conventional translating devices of the type shown by T3 in FIGS. 1 and 2;
- if the kiln is to be used for operation with a short cycle, it is simple to place a supplementary translating device, similar to the upper means, at the desired height of the stacks of trays, to move a limited number of trays along a short path closed in a loop between the loading and unloading stations, and it is simple to use the supplementary elevating device to raise the stacks of trays not included in the short path, to release them from the action of the lower elevating and lowering device. The auxiliary translating device for the short cycle is also located outside the plan dimensions of the trays and cannot deposit dirt on the dried articles.

BRIEF DESCRIPTION OF DRAWINGS

Further characteristics of the invention, and the advantages derived therefrom, will be made clearer by the following description of a preferred embodiment of the invention, illustrated purely by way of example and without restrictive intent in the figures of the attached sheets of drawing, in which

FIG. 16 shows from the side the means which raise and lower the hook-shaped tray-gripping levers of the conveyor of FIG. 14;

FIGS. 20 and 21 show schematically and in lateral elevation a two-stack kiln shown in successive stages of a normal operating cycle;

DETAILED DESCRIPTION OF THE PREFERRED EMBODIMENTS

Figure 6:
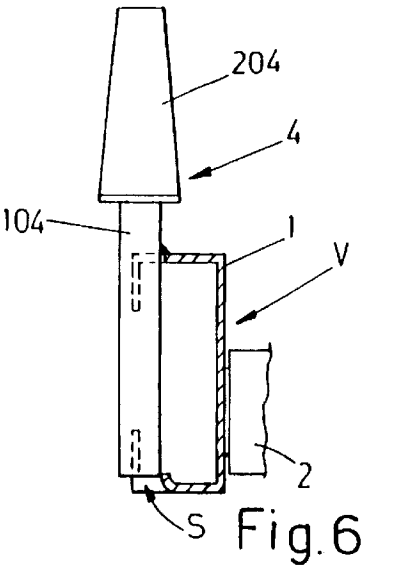
FIG. 6 shows a detail of a spacer of a tray, shown by transversely cutting a side member of the tray at the point where the said spacer is fitted.
Figure 7:
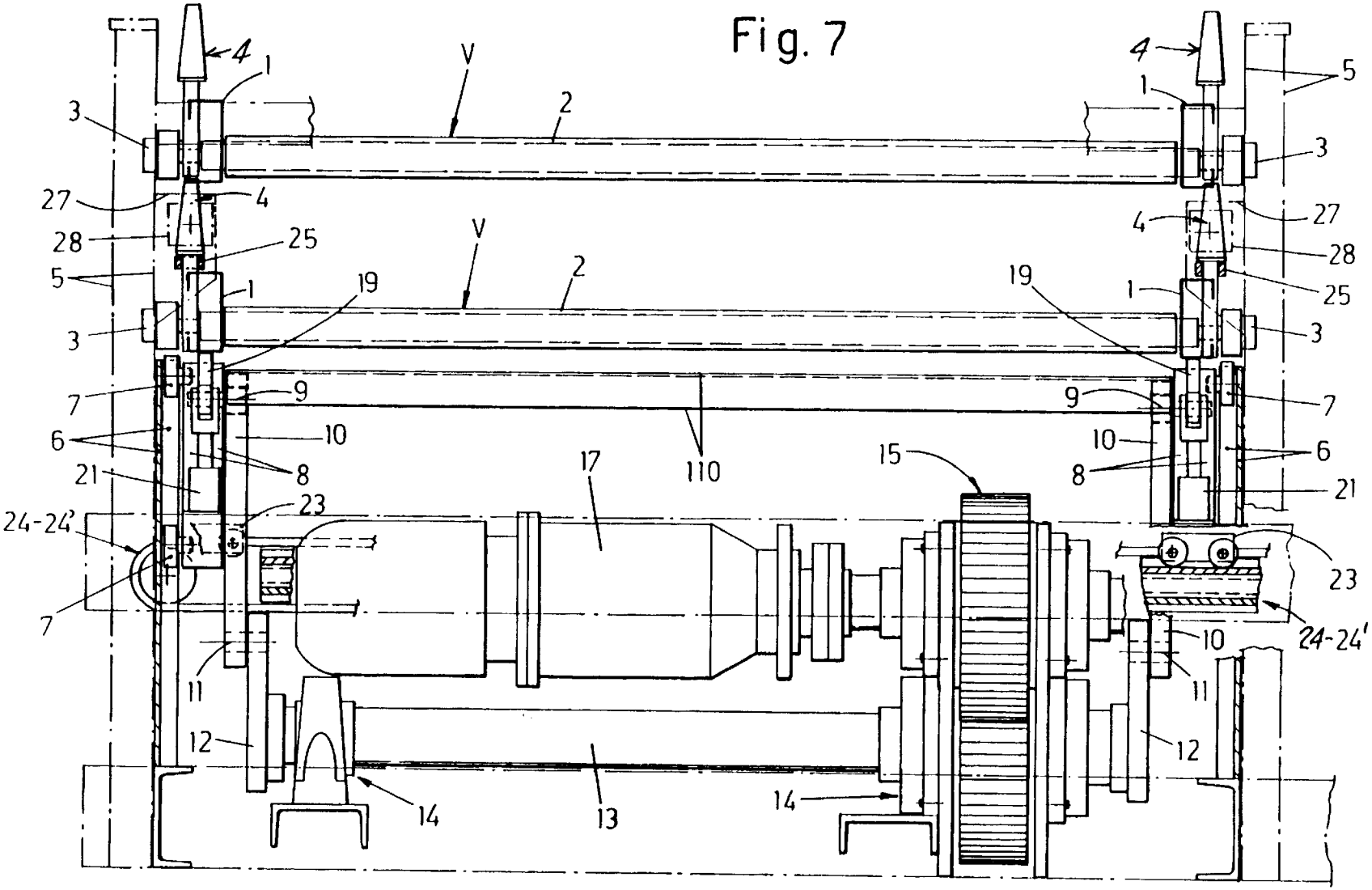
FIG. 7 shows on an enlarged scale and from the side, as in FIG. 4, a stack of trays of the kiln, with the corresponding means of moving the trays vertically, shown in the high position.
Figures 8, 9:
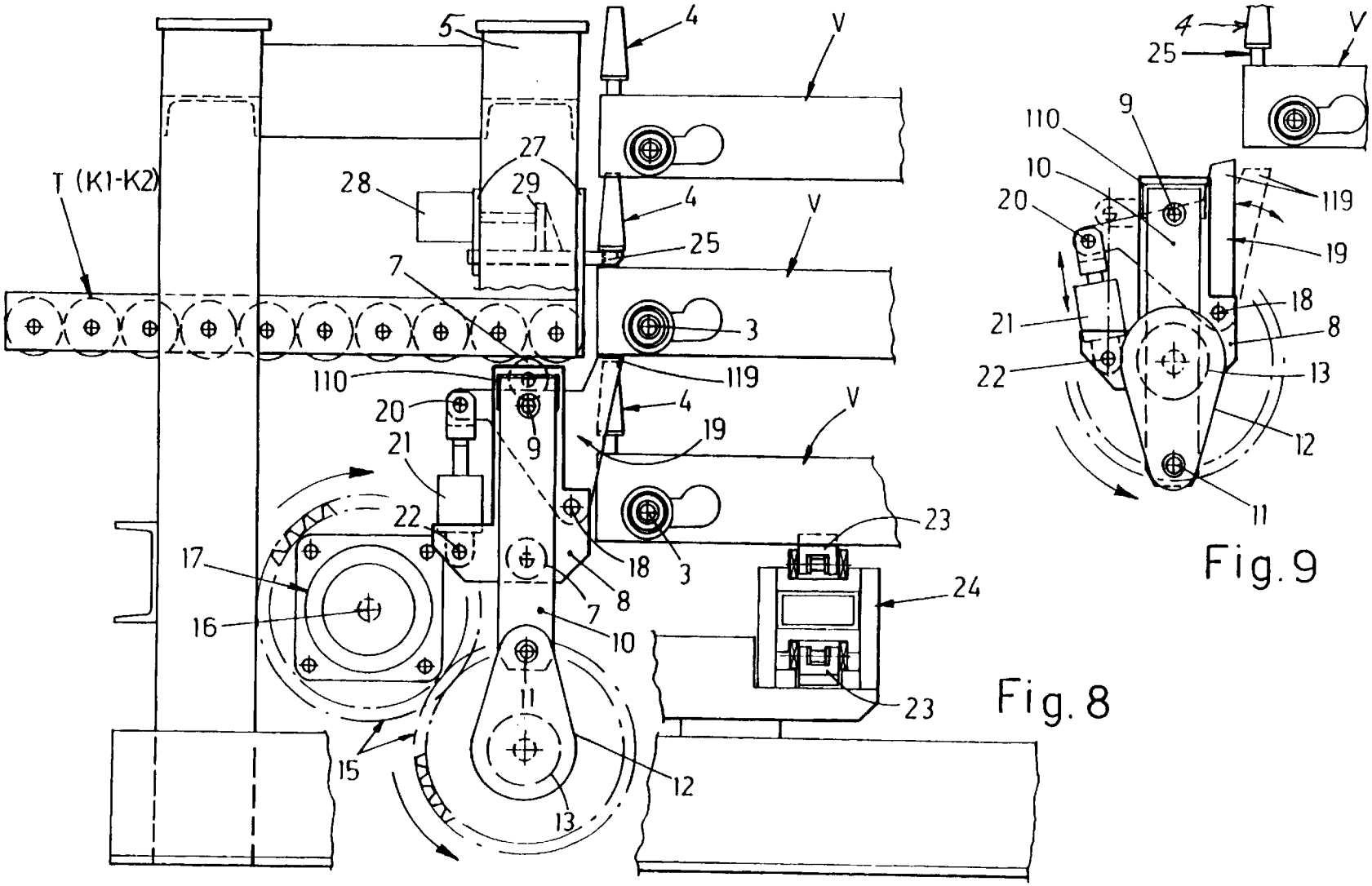
FIG. 8 is a front elevation of the stack of trays of FIG. 7, with means of moving the trays vertically, in the high position.
FIG. 9 shows, in a front elevation and in the low and retracted rest position, one of the means of moving the trays vertically.

With reference to FIGS. 3 to 8, it can be seen that, in the kiln in question, use is preferably made of trays V of the type with a conveyor belt base which can be operated from a power take-off located at the end of each tray, so that it is not necessary to have conveyors with powered rollers under the trays at the loading and unloading stations; these conveyors would be required if the trays were of the type with a lattice base. However, it is to be understood that the kiln according to the invention is also considered to be protected even if adapted to the use of trays with lattice bases. The details of FIGS. 7 and 8 show that the tray V comprises two strong side-members 1, preferably made from a C-section or equivalent, interconnected by a flat stiffening structure which, at least at the ends, carries rollers around which runs the conveyor belt 2 which forms the base of the tray on which the articles to be dried are placed. The side-members 1 have a height greater than that of the conveyor base 2 and rise above the latter to contain the full height of the articles to be dried. The number 3 shows the power take-offs located on the outer sides of the side-members 1 and butting against at least one of the end rollers of the conveyor 2, to which rotation means of a known type are coupled when the trays reach the article loading and unloading stations, so that the upper branch of the tray conveyor advances at the same speed and in the same direction as the articles supplied by a conveyor T which is external to the kiln, and is aligned and coplanar with the tray conveyor 2 (FIG. 8).

According to the invention, as shown in FIGS. 6, 7 and 8, a shank 104 of a spacer 4 which, for example, projects from the top of the side-member and is, for example, provided with a conical or truncated conical head 204 with its diameter decreasing towards the top (see below) is welded in a suitable vertical seat at each end of the side-member 1 of each tray. The shank of each spacer 4 is suitably withdrawn from the base of the seat which houses it, so that a lower part S of this seat remains free and can be shaped in the form of a funnel to receive the top of the head of a spacer 4 when a plurality of trays of the type in question are stacked on top of each other as in FIGS. 7 and 8. The seats S which house the spacers 4, and the spacers themselves, are also preferably designed in such a way that, when the trays are stacked on top of each other, the spacers of the various trays are aligned axially with each other and bear on each other, in other words that the top of the head of one spacer touches the lower end of the shank of the spacer located above. The height of the spacers 4 is such that, when a plurality of trays are stacked on top of each other, the necessary space is left between the trays to contain, with clearance, the articles to be dried, and to allow the drying air to circulate freely.

Figure 1:
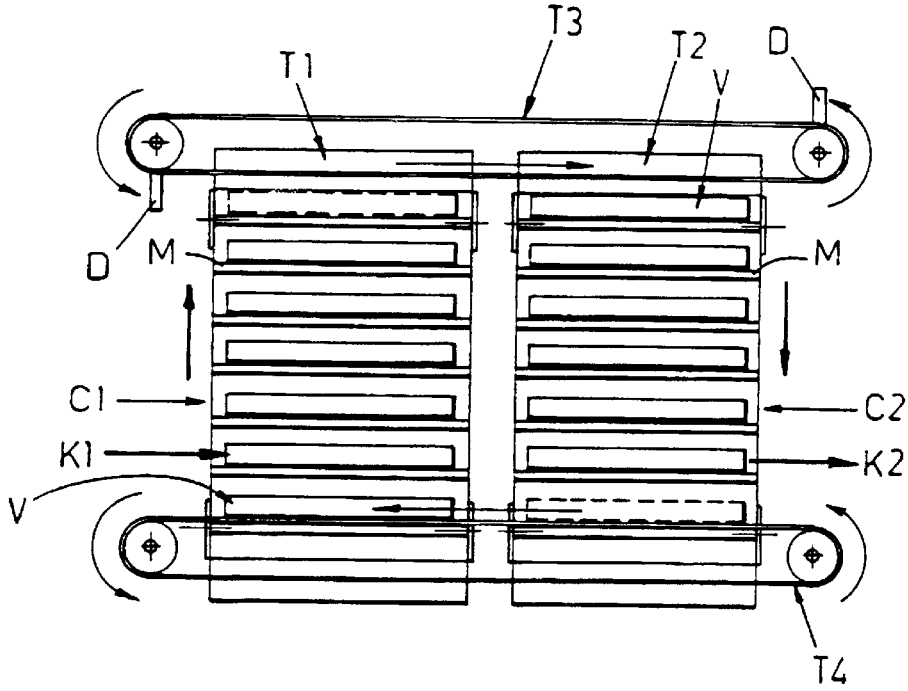
FIGS. 1 and 2 are schematic views, from the side and the front respectively, of a known two-stack kiln, of the type described in the introduction to the present description.
Figure 2:
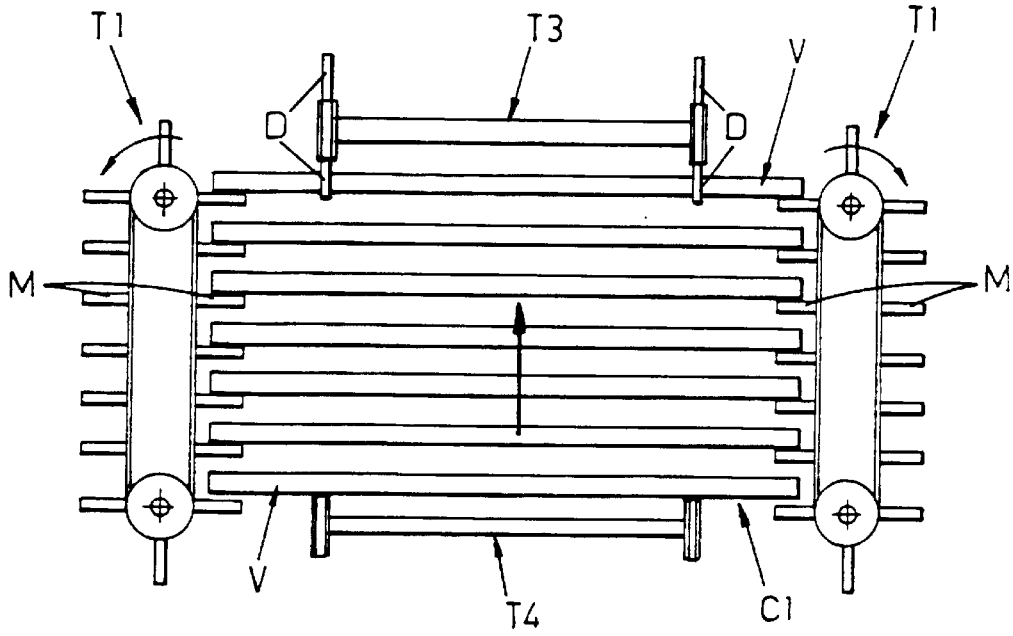
Figure 3:
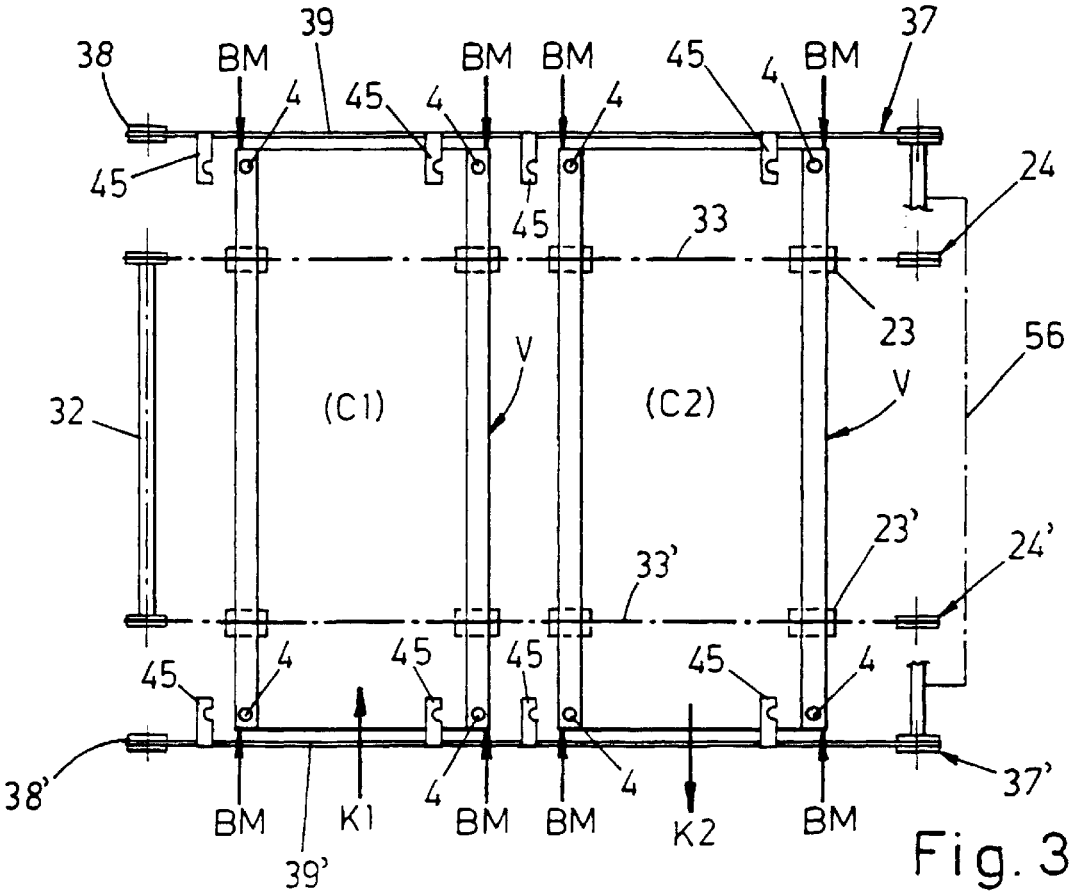
Figure 5:
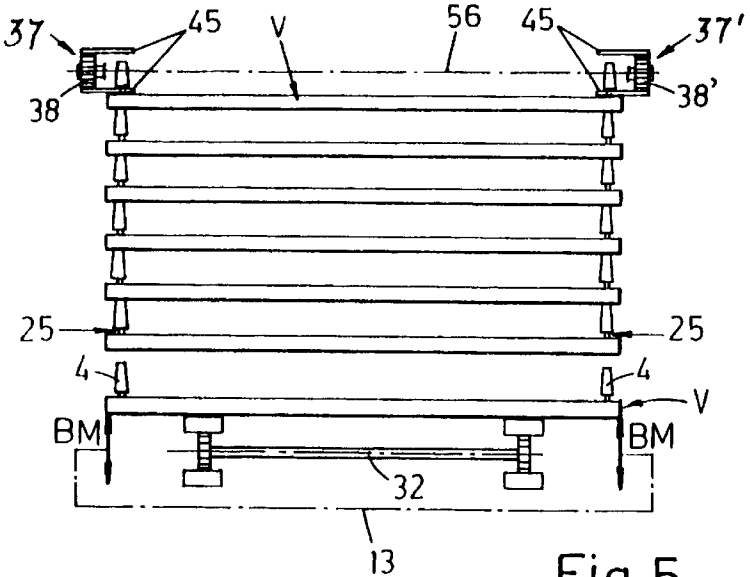

Because of the presence of the spacers 4, which create the interval between the various trays, it is possible to dispense with the conventional chain conveyors T1 and T2 of the known art (FIGS. 1, 2), since the elevation and lowering of the trays in the adjacent stacks C1 and C2 of a kiln as illustrated for example in FIGS. 3 and 5 can now be carried out by using means which elevate and lower only the bottom trays of the said stacks C1 and C2 by one step, in a cyclical way. The elevating and lowering system or device such as the elevating and lowering means BM usable for this purpose preferably act on the ends of the side-members 1 of the trays and can be of any type suitable for the purpose. Preferably, the elevating and lowering means are operated by connecting rod and crank systems which are moved by a common shaft which can be driven by a minimum force, since the systems are approximately 180° out of alignment and essentially balance each other, since the weight of the trays in the stack C2, which have to descend by one step in each cycle, discharges positive energy on to the shaft which operates the connecting rod and crank systems for elevating the trays in the stack C1.

FIGS. 7 and 8 show that the frame of the kiln has, at the positions of the ends of the side-members of the trays placed in the stacks C1, C2, uprights 5 on which are fixed vertical guides 6, of C-section for example, in which there run the rollers 7 of carriages 8 to which are pivoted at 9 connecting rods 10 which are orientated downwards and are pivoted at 11 on cranks 12 keyed with identical orientation on a horizontal shaft 13 supported rotatably by supports 14 fixed to the frame of the kiln. The number 110 indicates a cross-piece interconnecting each pair of connecting rods 10 of the means in question. The shaft 13 which carries the cranks for the stack C1 is connected by a positive transmission 15 to a parallel shaft 16 connected to a driving motor unit 17, of the type with electronic speed and phase control for example. The motion for the operation of the shaft with the cranks for the stack C2, which are out of alignment by approximately 180° with the cranks 12, is taken from the shaft 16 through a positive transmission, not shown in FIG. 7, identical to that indicated by 15.

A lever 19, of essentially triangular shape for example, has one of its vertices pivoted at 18 on each carriage 8, parallel to the shafts 13 and 16, and has a second vertex pivoted at 20 on the rod of an actuator 21, for example a jack which in turn is pivoted at 22 on an extension of the trolley 8. Depending on whether the rod of the jack 21 is extended or retracted, the third upper vertex 119 of the lever 19 is, respectively, located under the plan dimensions of a side-member 1 of a tray, as shown in FIG. 8, to raise or lower the tray through one step in the stack C1 or C2 of the kiln of FIGS. 3, 5, or withdrawn outside the stacks of trays, as shown in FIG. 9, so that it can return to the low position of the stack C1 or the high position of the stack 2, to repeat a new operating cycle without interfering with the tray driven by the lower translating device (see below).

The system of elevating the trays in the stack C1 (FIGS. 3–5) is such that the raised bottom tray in this stack is at a height where it does not interfere with the future empty tray which will be translated from the base of C2 to C1 (see below). Since the operating cycle of the kiln requires that the elevating system BM of C1 reverse its movement after the elevation travel, to permit the neutralization of the corresponding levers 19 and to return to the low position of the start of the cycle, means are provided in the stack C1 to hold in the high position the base tray which is cyclically raised and placed in the station K1 for loading the articles to be dried. These means are shown in FIGS. 7, 8 and 10, and consist of horizontal forks 25, mounted for example on the uprights 5 of the kiln frame, which are normally in a position of non-interference with the trays and which, on command, are extended and inserted, for example, into the upper projecting parts of the four spacers 4 of the raised tray, under the heads of the spacers, so that when the levers 19 of the elevating means of the stack C1 are lowered, all the trays of the stack C1 remain in the high position where they do not interfere with the subsequent empty tray which will then be translated by the lower translating means from the stack C2 to the stack C1.

Figure 10:
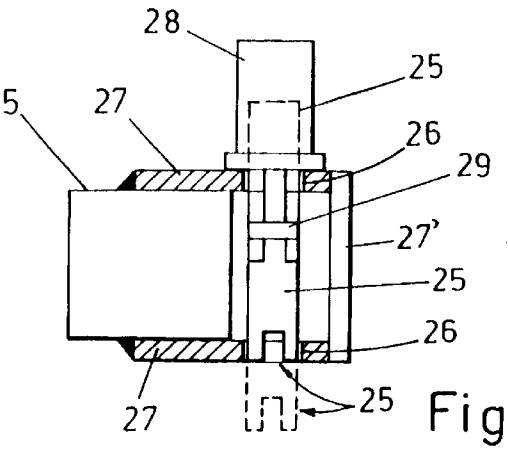
FIG. 10 shows, in a plan view from above and with parts in section, one of the forks which hold the trays in the raised position in the stacks.

FIGS. 7, 8 and 10 show, for example, that each fork 25 slides in guide seats 26 formed in a pair of plates 27, parallel to each other, positioned sideways, welded to the upright 5 and interconnected if necessary by a stiffening cross-piece 27'. On the plate 27 opposite that from which the active end of the fork 25 is designed to project, there is fixed horizontally the body of a jack 28, whose rod is parallel to the said fork, passes through an aperture in the said plate 27 and is fixed to a cross-piece 29 integral with the fork, which can be moved longitudinally by the rod of the jack 28.

In the subsequent stage of raising of a tray in the loading station K1, it is specified that when the spacers 4 of this tray come into contact with the base of the tray held by the forks 25 of C1, these forks are retracted to permit the raising of the new tray and of the whole overlying stack of trays, and these forks are only reactivated at the end of the elevation travel, to hold the new bottom tray of the stack C1 at the correct height. In the kiln with two stacks of trays shown for example in FIGS. 3–5, forks 25, identical to those described for the stack C1, are provided to hold the bottom tray of the stack C2 in a raised position in which it does not interfere with the underlying tray which the lowering device has previously lowered from the lower part of this stack and have transferred on the carriages 23 of a lower translation device such as a pair of horizontal chain conveyors 24, 24' which are parallel to each other, orthogonal to the side-members of the trays and placed to form a link between the stacks C1, C2 (see below).

When a tray reaches the carriages of the translating conveyors 24, 24', the lowering device of the stack C2 undergo a small additional downward travel to allow the levers 19 of the system to be detached from the side-members of the lowered tray and to be retracted into the rest position of FIG. 9. When the translation of the tray by the conveyors 24, 24' has been completed, or in step with this translation, the lowering device of C2 returns to the high position, with the levers 19 which at the appropriate time are extended and positioned under the base of the tray held by the forks 25 of C2. When the levers 19 have touched the bottom tray of C2, the forks 25 of this stack are retracted and all the trays of the stack C2 are lowered by the lowering device with the levers 19. The lowering of the trays in C2 is stopped temporarily or decelerates when the spacers of the next-to-bottom tray of C2 reach the height of the forks 25, which are activated at the correct time to hold this tray together with the trays above it, after which the lowering device is restarted or accelerate and return to the original speed, to deposit the tray associated with these on the carriages 23 of the lower translating conveyors 24, 24', in such a way that this tray is suitably spaced apart from the new bottom tray of C2 and can be translated by the conveyors 24, 24'. The tray held by the forks 25 in the stack C2 interacts with the means of the unloading station K2 which remove the dried products from it.

The following flow chart indicates the sequence of the operating steps of the elevating and lowering system which operate in the stacks C1 and C2.

| C1 | C2 |
|---|---|
| Levers 19 active, start of upward movement and raising of tray from the conveyor 24, 24' | Levers 19 are active, forks 25 are disabled and lowering of all trays commences |
| Contact of raised tray with bottom tray of C1, forks 25 are disabled and all trays of stack C1 are raised | Lowering of all trays of C2 |

-continued

| C1 | C2 |
|---|---|
| Raised bottom tray aligned with loading station K1, forks 25 of C2 come into operation with halt or deceleration of elevator and neutralization of levers 19 | Next-to-bottom tray aligned with unloading station K2, forks 25 act on it as the lowering device stops or decelerates |
| The inactive elevator passes through an additional idle upward travel | Tray carried by the lowering device descends, comes to rest on the conveyor 24-24' and is released by the neutralization of levers 19 |
| Inactive elevator descends and stops or decelerates slightly before the lower end stop | Lowering device is raised and stops or decelerates slightly before the upper end stop |
| Elevator completes its descent and levers 19 are activated under the tray | Levers 19 are activated and the lowering device completes its upward travel to contact the tray. |

If necessary, the vertices 119 of the levers 19 of the elevating and lowering system which operate in the stacks of trays of the kiln can be provided with small projections which are used for centering in the lower seats S of the trays under the spacers 4 of the trays.

Figure 12:
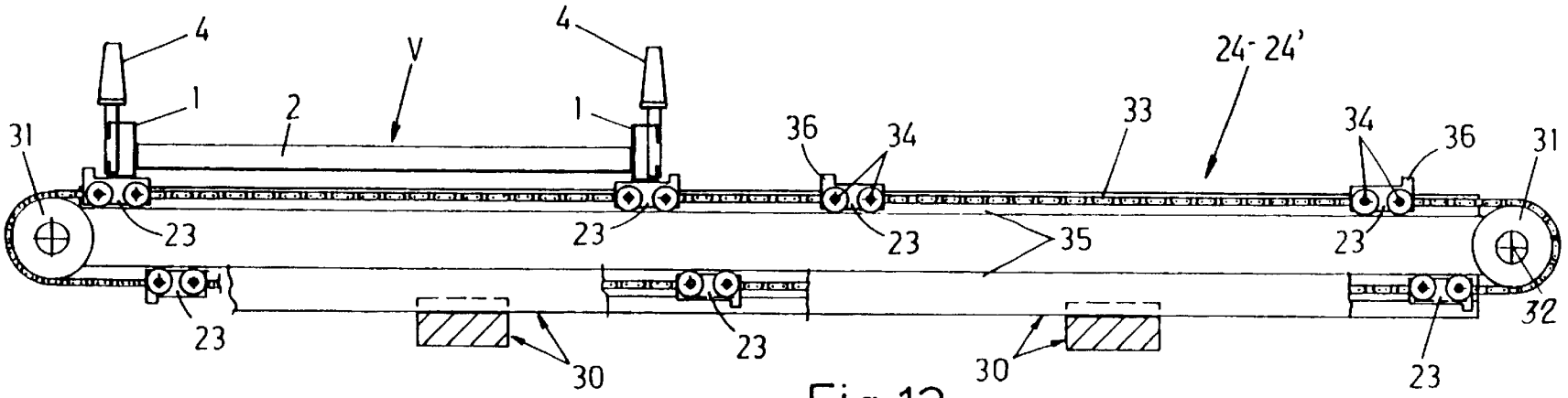
FIGS. 12 and 13 are lateral and front views respectively, with parts in section, of the lower translating conveyor which transfers the trays from the unloading station to the loading station.
Figure 13:
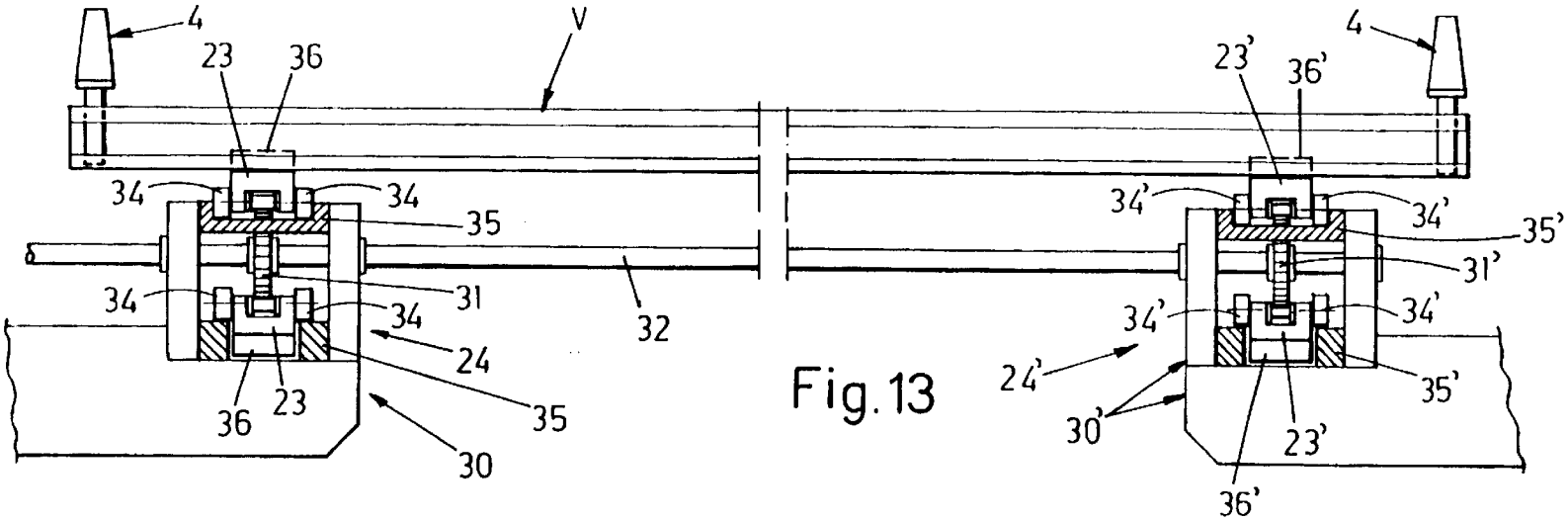

FIGS. 12 and 13 show that the lower translating conveyors 24, 24' comprise corresponding rectilinear base structures 30, 30', the ends of which carry sprockets with horizontal axes 31, 31', a pair of which is interconnected by a shaft 32 which in turn is connected to a common source of intermittent rotary motion (not illustrated). Around the sprockets 31, 31' there run chains 33, 33' to which are fixed U-shaped carriages 23, 23', whose wheels 34, 34' run in guides 35, 35' associated with the structures 30, 30'. In passing along the upper branch of the conveyors 24, 24', the carriages 23, 23' project suitably from the corresponding guides 35, 35', so that the tray V which is cyclically carried on these carriages does not interfere with the guides. The carriages 23, 23' can advantageously be provided on their opposite ends with projections 36, 36' which act as centring devices and which prevent undesired movements of the trays during the translation.

FIGS. 3 and 5 show how, in the kiln in question, owing the absence of conventional chain conveyors for the raising and lowering of the trays, it is possible to place at the tops of the stacks C1 and C2, parallel to the short sides of the trays and outside the stacks, conveyors of any type 37, 37' which act in step with each other to hold the top tray of the stack C1, raise it suitably to space it apart from the underlying tray, and translate it on to the stack C2, depositing it on the top tray of this stack. These conveyors, being placed at the sides of the stacks of trays, cannot deposit dirt on the trays, as can occur in the known art.

Figure 14:
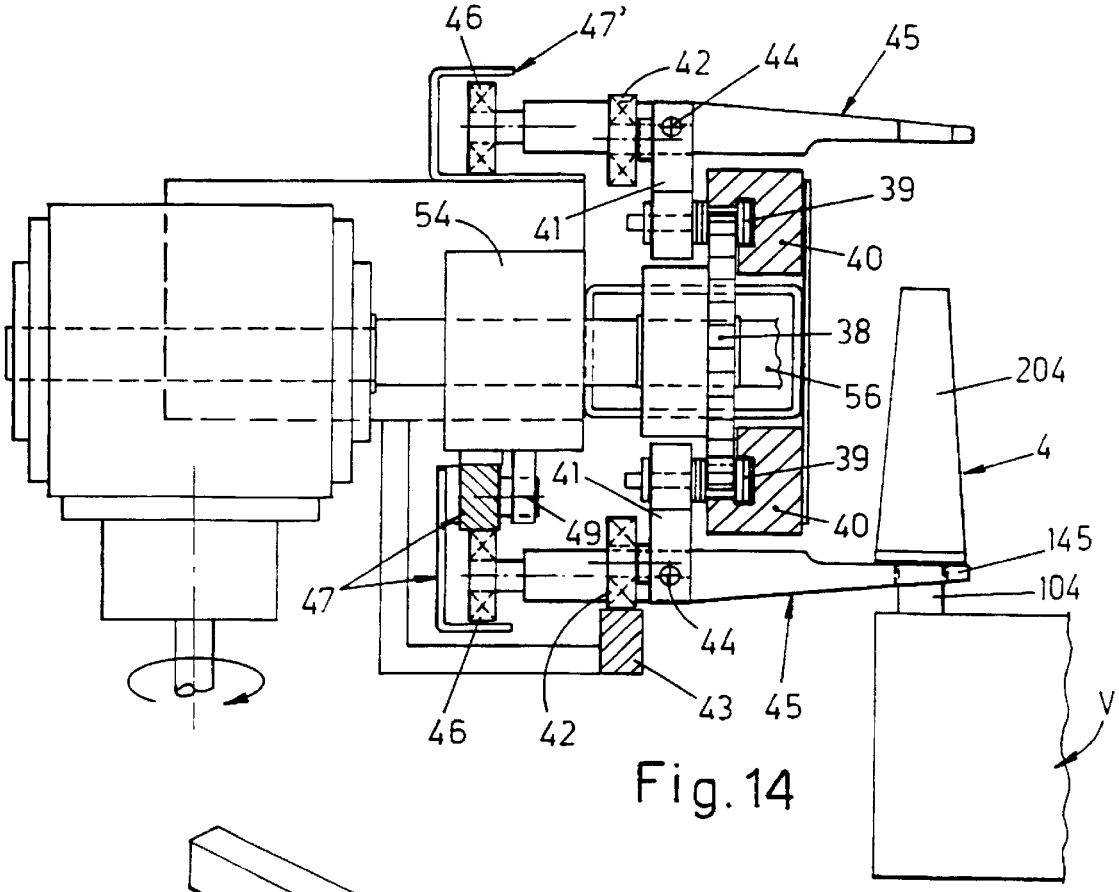
FIG. 14 shows from the front, in partial section and in the active stage, one of the upper translating tray conveyors.
Figure 15:
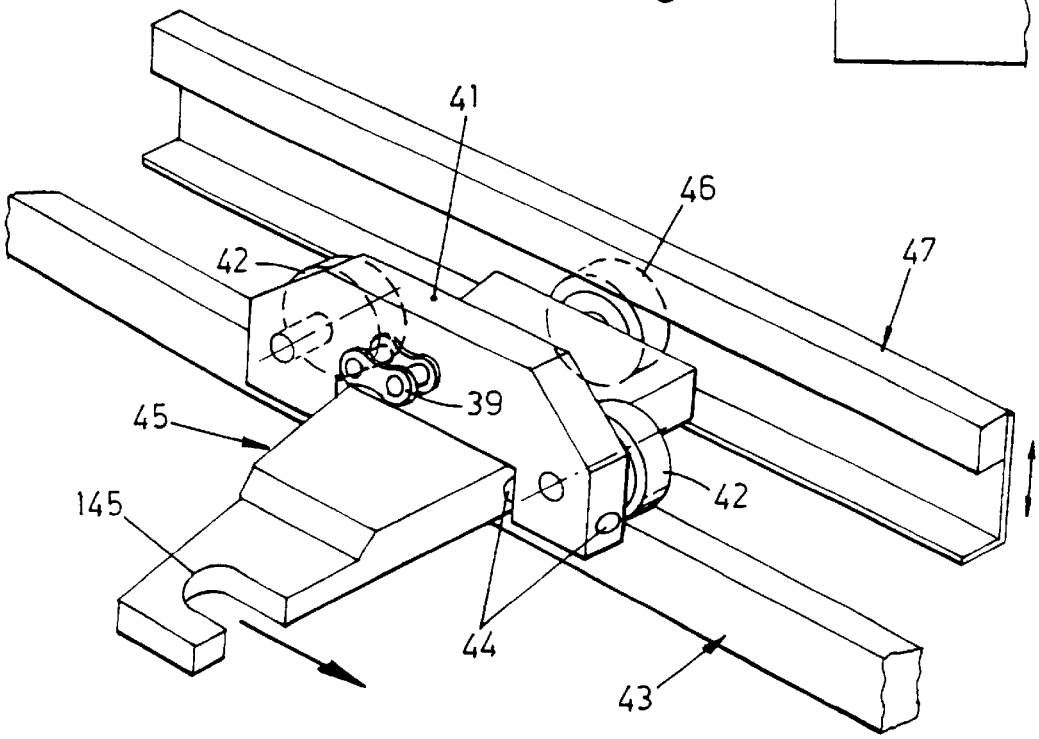
FIG. 15 shows in a perspective view one of the hook-shaped wheeled oscillating tray-gripping levers of the conveyor of FIG. 14.

According to the invention, the upper translating conveyors 37, 37' are designed to hold the tray to be translated by its spacers 4, as will now be described with reference to FIGS. 5, 14, 15 and 16. The conveyors in question comprise corresponding support structures fixed to, and projecting from, the frame of the kiln, the ends of these structures carrying rotatable sprockets 38, 38' (FIG. 5) with horizontal axes, around which run chains 39, 39' (FIG. 3) whose rectilinear branches are controlled by guides 40 (FIG. 14) fixed to the said support structure. Carriages 41 (FIGS. 14, 15), each provided with a pair of wheels 42 which run on a rectilinear fixed guide 43, at least when passing along the lower branch of the conveyors in question, are fixed to the chains with the same spacing between them as that found between a pair of spacers 4 at one end of a tray V. The carriages 41 are of forked shape, so that the intermediate part of a corresponding flat lever 45 can be pivoted to them at 44, the portion of the lever facing the stack of trays being shaped in the form of a horizontal hook 145, with its aperture orientated in the direction of translation of the trays. At its end opposite the hook-shaped end, the lever 45 carries a roller 46 with a horizontal axis, which as it passes along the lower and upper branches of the conveyors runs in grooved guides 47, 47', the latter of which is fixed. The lower guide 47 can be moved vertically on command to cause the oscillation of the levers 45 required for the raising and lowering of the tray. FIGS. 14 and 16 show how the guide 47 is pivoted at 48 on connecting rods 49 which in turn are pivoted at 50 to one of the vertices of a corresponding number of triangular plates 51, pivoted at 52 on the fixed support structure G of the conveyor. The third vertex of each plate 51 is pivoted at 53 to the rod of a respective jack 54, the body of which in turn is pivoted at 55 to the said fixed structure G. The number 78 indicates a connecting rod for synchronizing the oscillatory movement of the plates 51. Clearly, after the retraction of the rods of the jacks 54, the double guide 47 is raised and the active ends of the hook-shaped levers 45 are lowered, whereas when the rods of the said jacks 54 are extended, the double guide 47 is lowered, raising the said hook-shaped levers 45. The conveyors 37, 37' are synchronized by an interconnecting shaft 56, part of which appears in FIG. 14 and in FIG. 5, which show how the conveyors 37, 37' act on the trays V with the levers 45 which travel along the lower branches of these conveyors. These figures also show how the distance between the two frames of each conveyor 37, 37' is such that the levers 45 passing along the upper branch do not interfere with the spacers 4 of the trays translated from the lower branch by the conveyors in question.

The conveyors 37, 37' operate in the following way. FIGS. 3, 5 and 20, 21 show the stages of operation of a two-stack kiln in the normal cycle. At the start of the cycle, the conveyors 37, 37' are in the rest position, with corresponding pairs of hook-shaped levers 45 above the stacks C1 and C2, in the low position and suitably retracted in the direction of operation with respect to the vertical alignments with the spacers 4 of the trays in each stack. FIG. 2 shows the instant at which the elevating and lowering system of the connecting rod and crank type BM have raised and lowered the trays in the stacks C1 and C2 respectively, and when the forks 25 have acted to keep the new bottom trays of the stacks C1, C2 raised, to enable the elevating and lowering system to reverse its motion.

Figure 4:
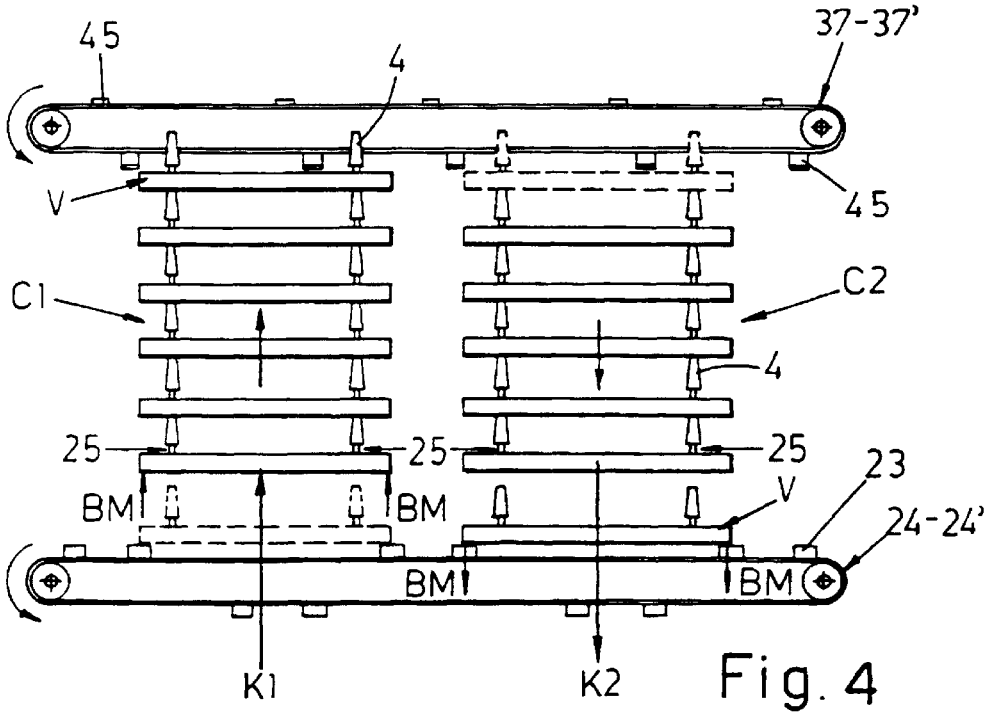
FIGS. 3, 4 and 5 are schematic views, in plan from above and in lateral and frontal elevation respectively, of a two-stack kiln according to the invention.

After this step, the trays of the stack C2 are aligned horizontally with the adjacent trays of the stack C1, and there is a tray missing from the top part of the stack C2 so that the step of transferring a tray from the top part of C1 to that of C2 can take place. FIG. 21 illustrates this step. The conveyors 37, 37' are started and a pair of their hook-shaped levers 45, in the low position, is inserted, for example, under the heads of the spacers 4 of the top tray of C1, after which these levers swing upwards and raise the tray which can thus be transferred from C1 to C2 without interfering with the underlying trays. When the translated tray has reached C2, the conveyors 37, 37' stop, their levers 45 of the lower branch are lowered to deposit the translated tray on the underlying tray of C2, and then the conveyors 37, 37' reverse their motion to retract their levers 45 from the spacers of the trays located at C1, C2 and to position themselves at rest, as shown in FIGS. 4 and 20, to enable the operating cycle to be repeated.

The kiln according to the invention can be set up to operate with a short cycle as described in the patent cited in the introduction to this description background section above, by placing auxiliary conveyors at the sides of the stacks C1 and C2, at the desired height, to translate the trays from C1 to C2, and by using means in addition to the forks 25 to raise the upper trays of C1 and C2 which are not included in the short cycle.

Figure 17:
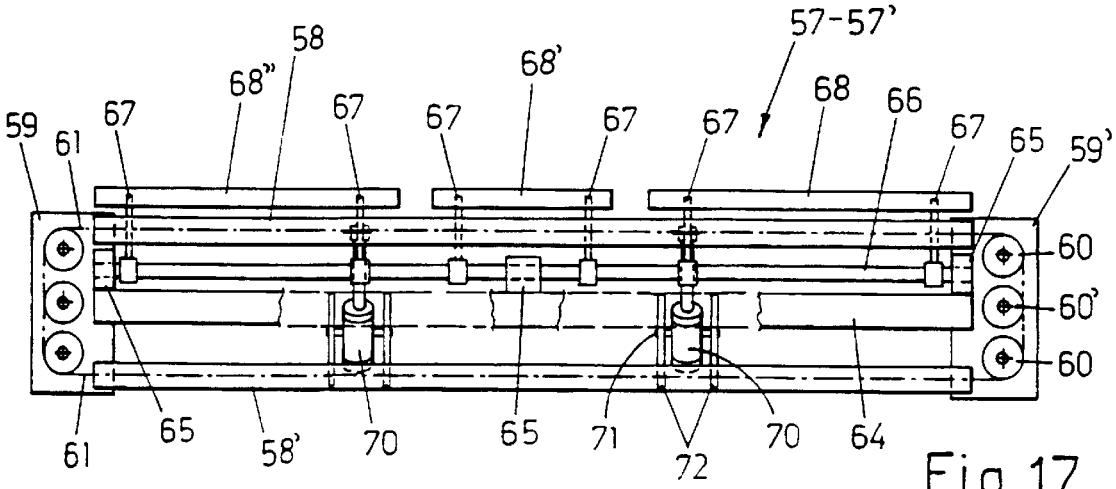
FIG. 17 is a schematic plan view from above of one of the supplementary translating conveyors for moving the trays in the short cycle path.

The auxiliary translation conveyors could be of the same type as the upper conveyors 37, 37', but with the possibility of carrying out horizontal movements towards and away from the stacks of the kiln, so that the levers 45 of these conveyors do not normally interfere with the rising and descending movements of the trays. Alternatively, the auxiliary translation conveyors can be of a dedicated type, as described below with reference to FIGS. 17–19.

Each auxiliary translation conveyor 57 comprises rectilinear parallel guides 58, 58' on the ends of which are fixed plates 59, 59' which carry sprockets 60, 60' which are rotatable about vertical axes and around which a chain 61 is run and tensioned, the opposite branches of this chain running in the said guides 58, 58'. Teeth 62, fixed to the chain 61 in the correct number and at suitable intervals, are normally located outside the plan dimensions of the stacks of trays of the kiln. Each tooth 62 can be provided at its top with a roller 63 with a vertical axis, which, as it passes along the rectilinear branches of the conveyor in question, interacts with dedicated parts of the guides 58, 58'. The chain of one conveyor 57 is clearly synchronized with that of the auxiliary opposite conveyor 57'. At a short distance from the guides 58 facing the trays of the kiln, there is a parallel beam 64, fixed to the end plates 59, 59', and supporting rotatably by support means 65 a parallel shaft 66 on which are keyed L-shaped levers 67 in a sufficient quantity to support three portions of rectilinear rails 68, 68' and 68" which are aligned with each other and parallel to the said shaft 66. The end rails 68, 68" are of such a length that they can be inserted under the short sides of the trays, without interfering with the lower seats S of the trays, in which, or in the vicinity of which, the spacers 4 of an underlying tray may be located (see below).

Figure 19:
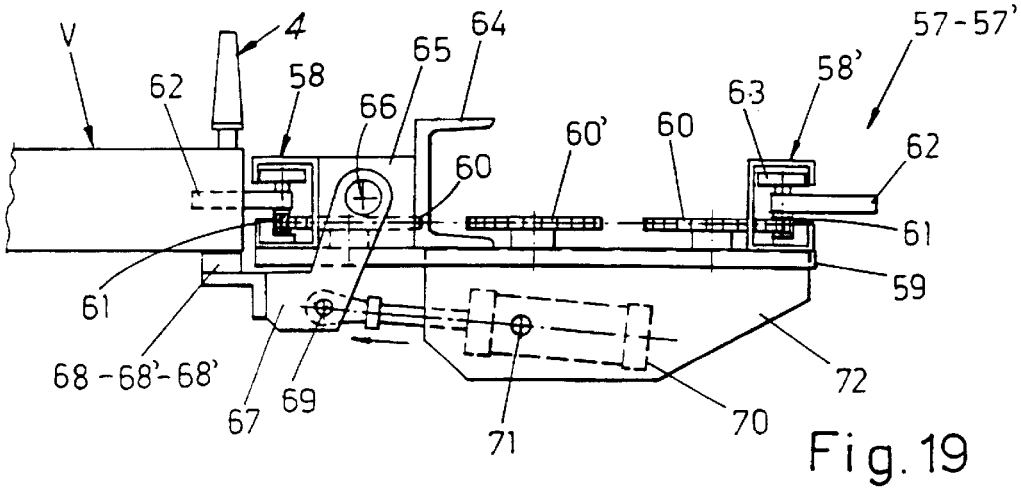
FIGS. 18 and 19 are front views of the translating conveyor of FIG. 17, in the rest position and in the active position respectively.

Some of the levers 67 are pivoted at their elbows, at 69, on the rods of jacks 70 pivoted by their bodies 71 on cross-pieces 72 shaped in the form of an inverted U and fixed between the beam 64 and the guide 58'. By the movement of the jacks 70, the rails 68, 68', 68" can be retracted into the rest position shown in FIG. 18, under the plan dimensions of the conveyor 57, 57', or can be raised and extended as shown in FIG. 19, for insertion under a tray, the tray being slightly raised if necessary.

Figure 11:
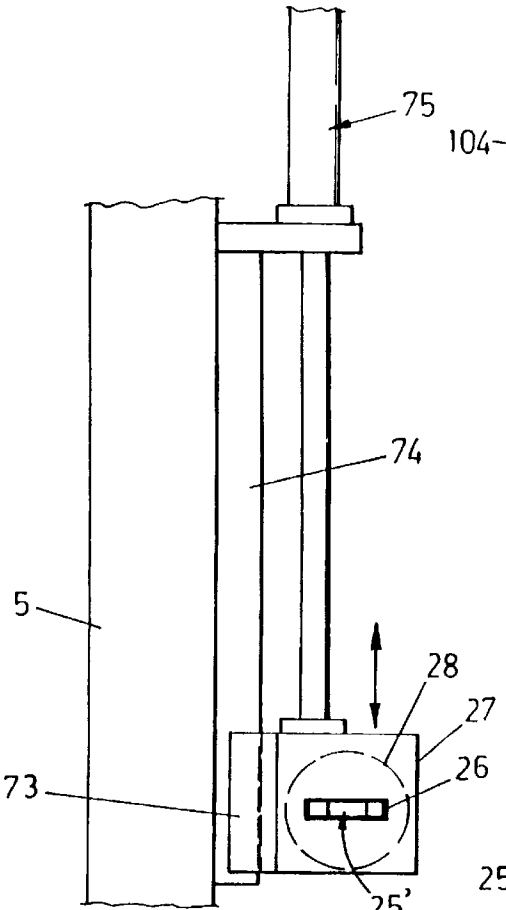
FIG. 11 shows, in a front elevation and in the rest stage, one of the auxiliary forks which, on command, raise the trays not included in the short cycle.

The other means required for the operation of the kiln in a short cycle are shown in FIG. 11, and comprise forks 25', identical to the forks 25 of FIG. 10 except in that the guide plates 27 are fixed on a sliding block 73 slidable on a vertical guide 74 fixed to the upright 5, on which is also fixed the body of a jack 75 which is fixed by its rod to the sliding block 73. Thus the auxiliary fork 25' can undergo a vertical raising and lowering movement of the correct extent, in addition to the normal horizontal movement towards and away from the trays (see below).

Figure 18:
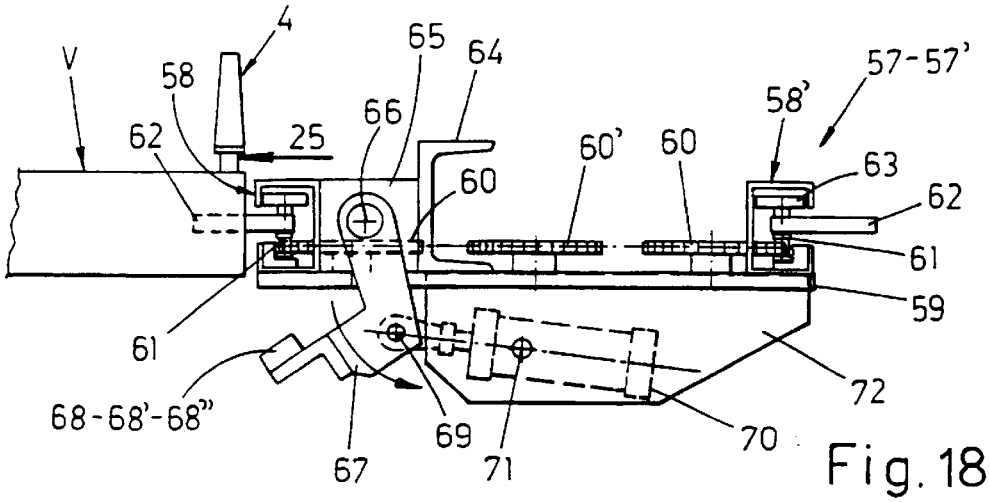
Figure 22:
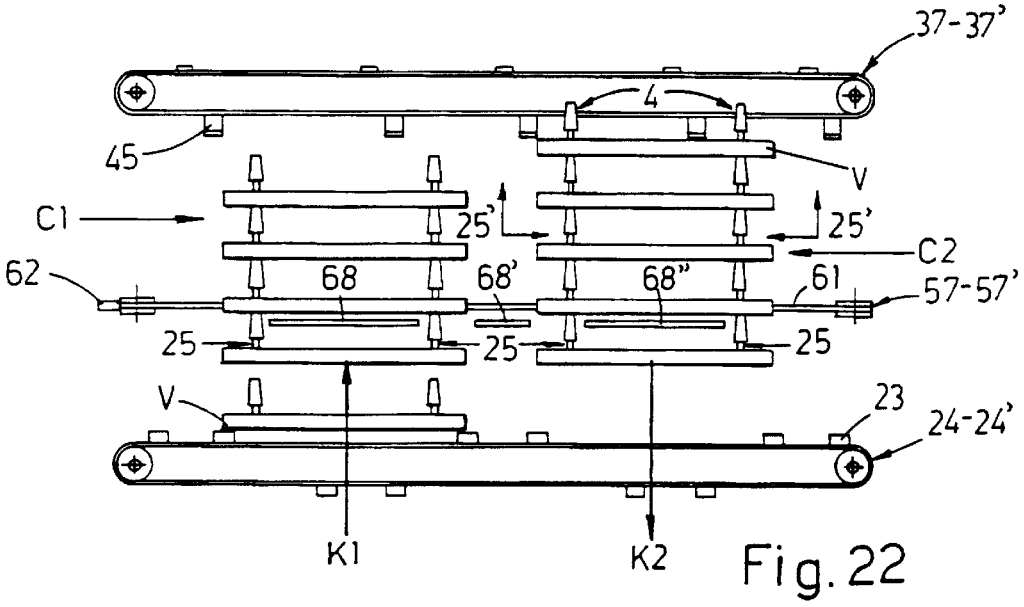
FIGS. 22, 23, 24 and 25 show schematically and in lateral elevation a kiln with two stacks of trays, shown in hypothetical successive stages of operation in a short cycle.

With reference to FIGS. 22–25, a description will now be given of the way in which a kiln of the type in question can be set up to operate with a short cycle. In FIG. 22, for example, it is assumed that the operation of the kiln with a short cycle takes place with the translation from C1 to C2 of the tray which is above that which is cyclically held by the forks 25 of C1, and therefore the auxiliary conveyors 57, 57' have been located at this height, only one of these conveyors being visible in the rest position as shown in FIG. 18.

Figure 23:
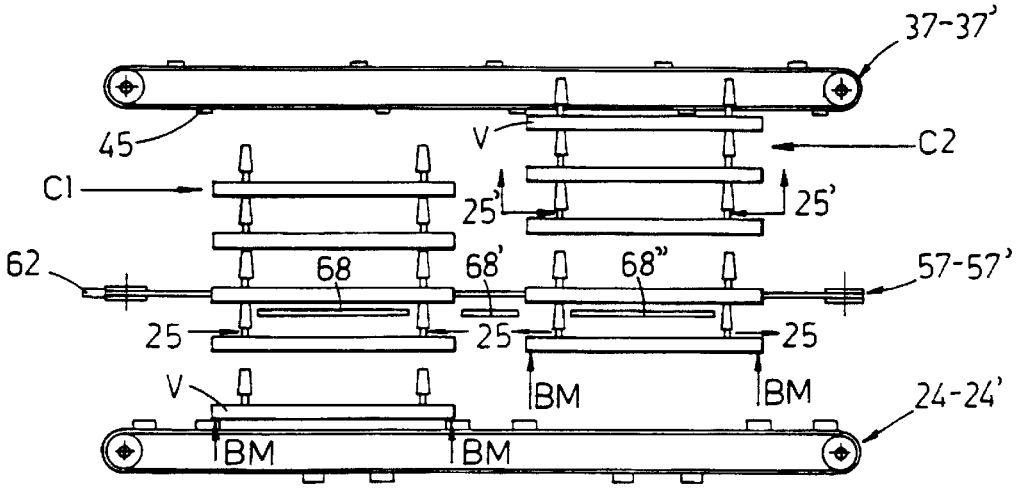
Figure 24:
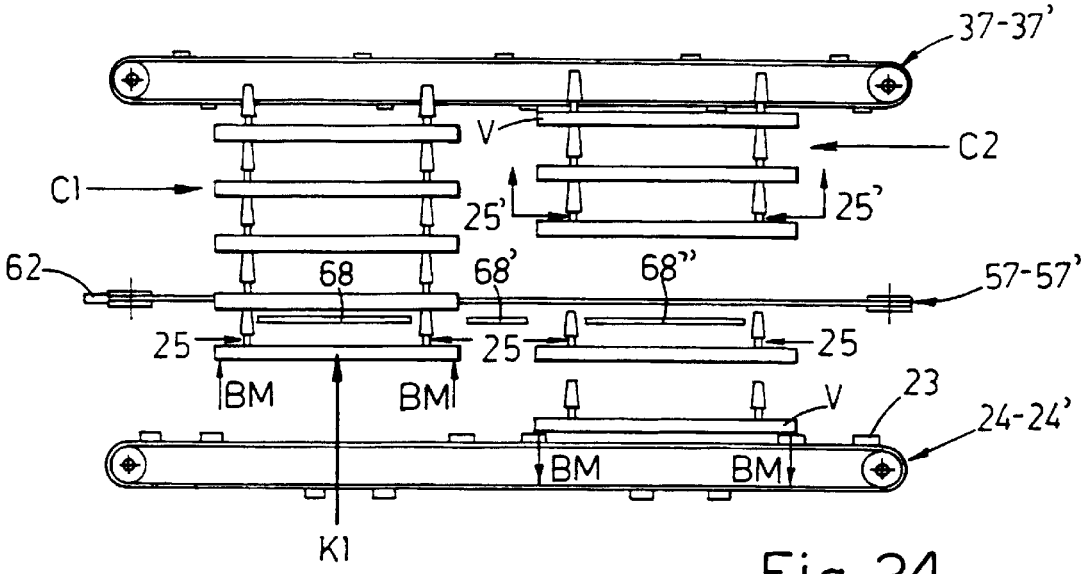

Auxiliary forks 25' are provided in the stack C2 to act, on command, on the tray above that located at the height of the conveyors 57, 57'. FIG. 22 shows the point of the cycle at which an empty tray from the stack C2 has been transferred by the conveyors 24, 24' into the stack C1 where, at the station K1, there is for example an empty tray which is loaded with products to be treated in the short drying cycle. In the stack C2, a tray is located at the station K2, for example, for unloading the products dried by the normal cycle, and the tray located above K2 also contains, for example, products treated by the normal cycle. The forks 25 are active in both stacks C1 and C2. The upper conveyors 37, 37' have their hook-shaped levers 45 in the retracted rest position and are stationary. In the stage shown in FIG. 23, the auxiliary forks 25' of the stack C2 have raised the trays located above the tray which is at the height of the translation conveyors 57, 57', while the lowering means BM hold the tray emptied at K2 and the forks 25 are disabled to allow the descent of the two trays. FIG. 24 shows how the tray which was previously at K2 has been transferred to the carriages 23 of the lower conveyors 24, 24' and how the tray located above has been held by the forks 25 at the unloading station K2. Meanwhile, in the stack C1, the elevating means BM have been started to insert a new empty tray into the loading station K1, while the previously filled tray has been raised to the height of the conveyors 57, 57'.

Figure 25:
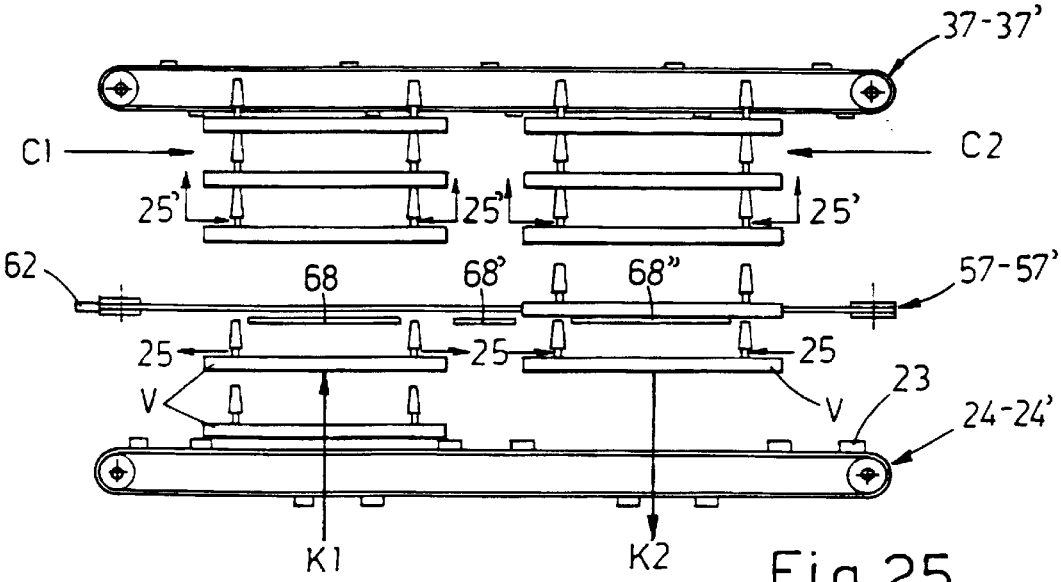

In the following stage shown in FIG. 25, the auxiliary forks 25' in the stack C1 come into action, to raise all the trays above the tray filled with the product for the short cycle, which is then transferred, by the auxiliary conveyors 57, 57' which are started at the correct time, from C1 to C2, while a new empty tray is transferred from C2 to C1 by the lower conveyors 24, 24' The short cycle continues with only four trays included in the cycle of raising and lowering and upper and lower translation, while all the other trays remain stationary and can contain products from a preceding normal operating cycle.

In the cycle described with reference to FIGS. 22 to 25, it is clear that, after the intervention of the auxiliary forks 25' in the stack C2, the elevating and lowering means BM of the two stacks are unbalanced, in that the weight of six trays bears on the elevating means of the column C1, while the weight of only two trays bears on the lowering devices of the column C2 (see FIGS. 23, 24). This unbalancing causes an excessive load on the geared motor which drives the elevating and lowering means, and which for this reason has to be designed with excess capacity. To avoid this problem, the auxiliary forks 25' of the stack C1 can be made to act simultaneously with the action of the auxiliary forks 25' of the column C2, to raise the trays, starting from that located at the height of the auxiliary conveyors 57, 57', in such a way that the kiln immediately enters the condition shown in FIG.

25, with equal numbers of trays resting on the elevating and lowering means of the columns C1 and C2. It is to be understood that other means can be provided for this purpose.

It is to be understood that conveyors of the same type as 57, 57' can be used in place of the upper translation conveyors 37, 37'.

It is also to be understood that kilns with more than two stacks of trays also lie within the scope of the invention.

Figure 26:
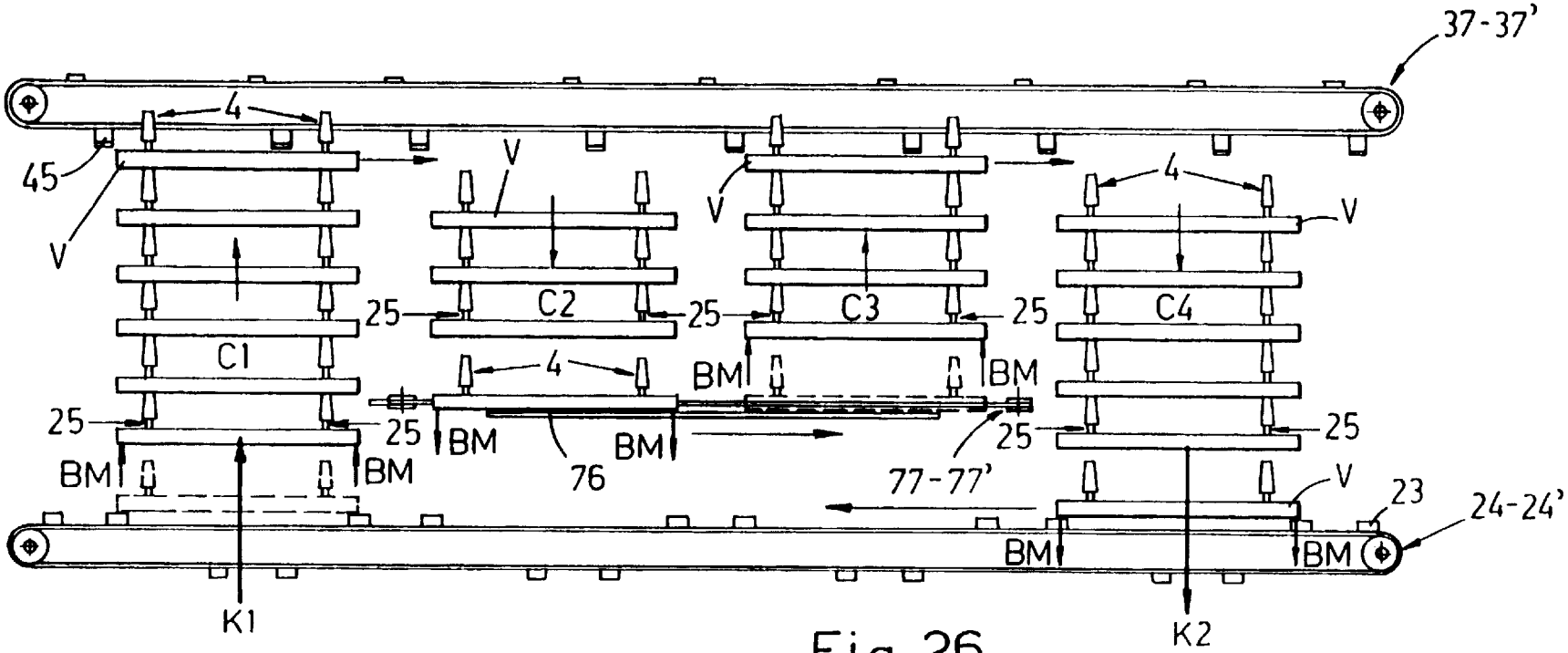
FIG. 26 is a schematic lateral view of a possible embodiment of the means of moving the trays in a four-stack kiln.

FIG. 26 shows, for example, a kiln of the normal cycle type, with four stacks of trays C1, C2, C3 and C4, provided with corresponding connecting rod and crank elevating and lowering means as described above, and with corresponding forks 25. The kiln is provided with the usual lower conveyors 24, 24' for translating the bottom trays from C4 to C1, and with the usual upper conveyors 37, 37' for simultaneously transferring a tray from C1 to C2 and from C3 to C4. To transfer the trays from the lower part of C2 to the lower part of C3, it is possible to use simple means which comprise horizontal fixed guides 76 for supporting the ends of the trays to be transferred, and which have lateral conveyors with pushing teeth 77, 77' similar to those used in the conveyors 57, 57' to translate the tray from C2 to C3. The conveyors 77, 77' and the guides 76, if located at a suitable level, can be replaced with conveyors 57, 57' for the short cycle, if these are arranged in a number of portions or sections located one after another, and if they are set up to have only the central section operating to transfer the trays from C2 to C3 in the normal cycle and to operate with all the sections combined in the short cycle, to transfer a tray directly from C1 to C4.

Figure 6A:
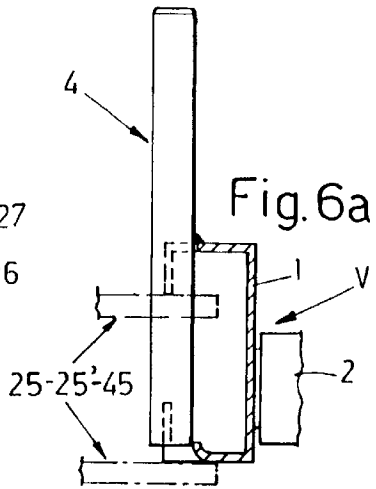
FIG. 6*a* shows a variant embodiment of the tray spacer, shown as in FIG. 6.

Another variant may relate to the fact that the spacers 4 have a different shape from that considered with reference to FIG. 6, to carry out the sole function of spacing, and if necessary centring, the stacked trays. For example, FIG. 6*a* shows the use of spacers 4 of a completely cylindrical shape without heads. In this case, the gripping of the trays by the grippers 25 and 25' which operate in the different stacks of the kiln can take place by the insertion of the grippers into the lateral cavities of the side-members and of the frames 1 of the trays, with the grippers bearing on the upper edges of the said side-members, as indicated by the broken line, or with the said grippers inserted into the spaces between the stacked trays and bearing on the bases of these trays, as indicated by the chained line. In the same way, the upper trays of the stacks can be held by the levers 45 of the upper translation conveyors 37, 37', provided that these are designed to be moved away from and towards each other at the correct time, so that the said levers do not interfere with the trays when they are at rest. Alternatively, the upper conveyors 37, 37' can be replaced with translation conveyors of the type indicated by 57, 57'.

A further variant may relate to the fact that the spacers 4 project from the bases of the trays instead of from their tops.

It is to be understood that the programming, control and safety means of the kiln have been omitted from the description, since they are readily understandable and can easily be constructed by those skilled in the art.

What is claimed is:

1. A vertical kiln comprising a drying chamber having two or more vertical and adjacent stacks of horizontal trays which are made to rise by steps in one stack and then to descend by steps in the next stack via an elevating and lowering system, and which are moved along horizontal translatory paths by a lower translation device for the transfer from the top of one stack to that of the adjacent stack and for the transfer from the end of the last stack to the start of the first stack, where stations for unloading and loading articles from and into the trays operate in operable positions, the elevating and lower system comprising, outside the stacks of trays, on the short sides of the trays, in the lower parts of the stacks, and in a quantity equal to one for each corner of the bottom tray to be raised and lowered, vertical guides integral with corresponding uprights of a kiln frame, on which slide corresponding carriages, each of which carries a lever pivoted parallel to the short sides of the trays, the lever being controlled by a jack which can bring an upper extension of the lever into an active position of projection under the corner area of the tray to be raised or lowered, or into a retracted position of non-interference with the trays, the carriages of the adjacent stacks of trays of the kiln operable in opposite elevating or lowering movements, wherein the trays arranged with vertical spacers so that the trays can be stacked on top of each other with sufficient spacing between them, and can be raised and lowered in the adjacent stacks by the elevating and lowering system which operates on the bottom trays of the stacks, to pick up and deposit the trays on the lower translation device at an appropriate time, a lowering device of the elevating and lowering system transferring an empty tray from a last stack to a first stack of the kiln, a bottom tray of the last stack being held at a given height, above the lower translation device, by grippers which are activated and disabled in step with the elevating and lowering system.

2. The vertical kiln according to claim 1, wherein the spacers are at least four in number and each is mounted vertically in a corner area of each tray and projects from the top of the tray.

3. The vertical kiln according to claim 1, wherein the spacers are located on the outer edges of the long sides of the trays providing a large portion of the short sides of the trays to remain free for gripping, by the translation device when the trays are stacked.

4. The vertical kiln according to claim 1, wherein each spacer projects from an upper part of the tray with a portion of a respective shank and when a plurality of trays are stacked on top of each other, an upper end of each of the spacers engages with an open funnel-shaped seat on a base of each tray, provided at a lower end of a hole formed in a side of the tray into which the shank of each spacer is inserted and welded, thereby providing mutual centering of the stacked trays.

5. The vertical kiln according to claim 4, wherein a lower end of the shank of each spacer reaches into the open funnel-shaped seat containing an upper end of a respective spacer when a plurality of trays are stacked on top of each other, whereby the spacers of the stacked trays touch each other.

6. The vertical kiln according to claim 1, wherein the trays have frames with side-members having an outwardly open profile, the spacers being located at the ends of the side-members being located inward from outer sides of the spacers or partially projecting from the outer sides of the spacers.

7. The vertical kiln according to claim 4, wherein the spacers are provided with heads tapered towards a top of the spacers.

8. The vertical kiln according to claim 4, wherein the spacers are in the form of rods, and have upper ends flared or rounded.

9. The vertical kiln according to claim 1, wherein the trays have bases in the form of conveyor belts or with latticed bases.

10. The vertical kiln according to claim 1, wherein the elevating and lowering system is driven with a travel longer than the interval between the stacked trays, to allow the levers of the elevating and lowering system to carry out without interference, oscillatory activating and disabling movement and to ensure that a tray held at an appropriate height by the grippers does not interfere with a tray subjected to the action of the lower translation device.

11. The vertical kiln according to claim 1, wherein the carriages of the levers are connected by connecting rods which in turn are pivoted on cranks keyed on the ends of shafts parallel to the short sides of the trays, and which, via positive transmissions of motion, receive an intermittent motion from a parallel main shaft driven by a motor unit with electronic or electromechanical speed and phase control.

12. The vertical kiln according to claim 7, wherein the grippers which hold the lowest trays of the stacks at an appropriate height, above the lower translation device which cyclically transfers a tray from a last stack to a first stack of trays of the kiln, are provided with a movement towards and away from the trays, and are such that the grippers act on portions of the spacers located under respective heads of the spacers, whereby the heads bear on the grippers.

13. The vertical kiln according to claim 8, wherein the grippers which hold the lowest trays of the adjacent stacks an appropriate height and which are provided with a movement towards and away from the trays, wherein the grippers act in an open cavity of a respective tray towards the exterior of side-members of a frame of the respective tray, and wherein the grippers bear on upper edge of the side-members.

14. The vertical kiln according to claim 8, wherein grippers which hold the lowest trays of the stacks at an appropriate height and which are provided with a movement towards and away from the trays, bear on respective bases of side-members of frames of the trays.

15. The vertical kiln according to claim 1, wherein the gripper which holds the lowest trays of the first and last stacks at the appropriate height comprise forks orthogonal to short sides of the trays, supported by a horizontal guide which is fixed to uprights of a frame of the kiln and on which the forks can be moved longitudinally by jacks which can bring active edges of the forks from a rest position, in which the edges are retracted from the trays, to a position of gripping the tray to be held at the appropriate height, in which the active edges of the forks are fitted around the shanks of the spacers of the tray or under the tray.

16. The vertical kiln according to claim 1 wherein the lower translation device comprises a pair of parallel and horizontal conveyors having positive transmission, the pair of parallel and horizontal conveyors having carriages fixed thereto which, as the carriages pass along an upper branch of the conveyors, project from corresponding fixed guides to receive intermediate parts of side-members of the frame of the kiln, the carriages being provided with opposite end projections which act to contain the tray, to prevent the tray from moving in undesired ways during a translation stage.

17. The vertical kiln according to claim 1, further comprising an upper translation device which cyclically transfers a tray from the top of one stack of trays, which has an ascending movement, to the top of the adjacent stack of trays, which has a descending movement, the upper translation device comprising horizontal chain conveyors located at the sides of the tops of the stacks and parallel to the short sides of the trays, the chains of each conveyor running around end sprockets with horizontal axes, rectilinear branches of the chains being controlled by rectilinear guides which leave free one side of each chain, to which are fixed carriages spaced apart with the same distance between centers as that found between two spacers located on a short side of a tray, the carriages being provided with rollers which, as the carriages pass along a lower branch of the conveyor, run on a rectilinear fixed guide, and the carriages having levers pivoted parallel to the chains flat ends of these levers, shaped into horizontal hooks projecting towards the stacks of trays, above the plan dimensions of the stacks and with the opening of the hooks orientated in the direction of translation of the trays, while the opposite end of each of the levers carries a roller which as it passes along the rectilinear branches of the conveyor, interacts with rectilinear guides the lower of which is grooved, double-acting, and is connected to the elevating and lowering system, for lowering and elevating, the hook-shaped ends of the levers, respectively, the hook-shaped levers gripping the upper tray of the stack with the ascending movement as the hook-shaped levers pass along the lower branch of the conveyor, by upper projecting parts of corresponding spacers, under heads of the respective spacer, after which the levers rotate to raise the gripped upper tray, to space the gripped tray apart from the underlying tray and to enable the gripped tray to be translated, while on completion of the translation, the levers rotate in the opposite direction, to lower the translated tray and deposit the tray on the underlying tray, after which the conveyor reverses movement to retract the hook-shaped levers, to bring the hook-shaped levers to a position in which the hook-shaped levers do not interfere with the spacers of the upper trays of the stacks.

18. The vertical kiln according to claim 1, wherein, when the kiln contains more than two adjacent stacks of trays, the lower translation device is adapted to cyclically transfer a lower tray of a stack of trays with a descending movement to the bottom of the adjacent stack of trays with ascending movement, the lower translation device having fixed lateral guides on which the tray to be translated is supported, and being provided with chain conveyors running around sprockets with vertical axes, located outside the stacks, parallel to the guides and to the short sides of the trays, and provided with pushing teeth which at the correct time push the tray so that it slides longitudinally on the guides.

19. The vertical kiln according to claim 1, wherein the translation device provides a path for at least a limited number of trays to carry out an annular movement along a short path in a short cycle as compared with a normal path in a normal cycle whereby the limited number of trays are raised to pass into a loading station, and then raised by one or more steps and then translated towards final stack where the trays descend to pass into an unloading station and then descend and are translated back into a first stack, under the loading station, for the repetition of the short cycle.

20. The vertical kiln according to claim 19, further comprising an auxiliary means for raising and holding trays not included in the short cycle the auxiliary means having auxiliary conveyors for translating the trays not included in the short cycle from the first stack with an ascending movement to the last stack with a descending movement.

21. The vertical kiln according to claim 20, wherein the auxiliary means comprises forks fixed to the uprights of the frame of the kiln with the interposition of a vertical guide and sliding block unit connected to a raising and lowering actuator.

22. The vertical kiln according to claim 20, wherein the auxiliary conveyor provide for movement towards and away from the stacks of trays, wherein in the normal operating cycle of the kiln, the hook-shaped levers of the auxiliary conveyors do not interfere with normal movement of the trays.

23. The vertical kiln according to claim 22, wherein the auxiliary conveyors can be used to translate the trays between the tops of the stacks when oscillating levers of the auxiliary conveyors act in cavities of frames of the trays or on bases of the trays.

24. The vertical kiln according to claim 20, wherein the auxiliary conveyors comprise rectilinear conveyors parallel to upper conveyors, the rectilinear conveyors having chains running around sprockets with vertical axes and with teeth, the rectilinear conveyors can carry out translation of the trays by pushing the trays, rails being provided under active branches of the upper conveyor and rectilinear conveyor and parallel to the upper conveyor and rectilinear conveyor, the rails being fixed to oscillating levers and connected to actuators which hold the rails in a retracted position in which the rails do not interfere with the trays, but which, can translate the rails and insert the rails under the tray or trays to be translated so that the rails bear on these trays and raise the trays in the appropriate way.

25. The vertical kiln according to claim 17, further comprising rectilinear conveyors with movable rails which can be used in place of the horizontal chain conveyors.

26. The vertical kiln according to claim 24, wherein the auxiliary means can be made in sections with independent movements such that the auxiliary means can provide the translation of the trays between lower parts of intermediate stacks of a kiln having more than two adjacent stacks of trays, when the kiln is operating with a normal cycle.

27. A vertical kiln comprising a drying chamber having two or more vertical and adjacent stacks of horizontal trays which are made to rise by steps in one stack and then to descend by steps in the next stack via an elevating and lowering system, and which are moved along horizontal translatory paths by a lower translation device for the transfer from the top of one stack to that of the adjacent stack and for the transfer from the end of the last stack to the start of the first stack, where stations for unloading and loading articles from and into the trays operate in operable positions, the trays being arranged with vertical spacers so that the trays can be stacked on top of each other with sufficient spacing between them, and can be raised and lowered in the adjacent stacks by the elevating and lowering system which operates on respective bottom trays of the stacks, which picks up and deposits the trays on the lower translation device at an appropriate time, a lowering device of the elevating and lowering system transferring an empty tray from a last stack to a first stack of the kiln, a bottom tray of the last stack being held at a given height, above the lower translation device, by grippers which are activated and disabled in step with the elevating and lowering device, wherein the gripper which holds the lowest trays of the first and last stacks at the appropriate height comprise forks orthogonal to short sides of the trays, supported by a horizontal guide which is fixed to uprights of a frame of the kiln and on which the forks can be moved longitudinally by jacks which can bring active edges of the forks from a rest position, in which the edges are retracted from the trays, to a position of gripping the tray to be held at the appropriate height, in which the active edges of the forks are fitted around the shanks of the spacers of the tray or under the tray.

28. A vertical kiln comprising a drying chamber having two or more vertical and adjacent stacks of horizontal trays which are made to rise by steps in one stack and then to descend by steps in the other stack via an elevating and lowering system, the trays moved along horizontal translatory paths by a lower translation device for the transfer from the top of one stack to that of the adjacent stack and for the transfer from the end of the last stack to the start of the first stack, where stations for unloading and loading articles from and into the trays operate in operable positions, the trays being arranged with vertical spacers so that the trays can be stacked on top of each other with sufficient spacing between them, and can be raised and lowered in the adjacent stacks by the elevating and lowering system which operates on respective bottom trays of the stacks, which picks up and deposits the trays on the lower translation device at an appropriate time, a lower device of the elevating and lowering system transferring an empty tray from the last to the first stack of the kiln, the bottom tray being held at a given height, above the lower translation device, by grippers which are activated and disabled in step with the elevating and lowering device; and an upper translation device which cyclically transfers a tray from the top of one stack of trays, which has an ascending movement, to the top of the adjacent stack of trays, which has a descending movement, the upper translation device comprising horizontal chain conveyors located at the sides of the tops of the stacks and parallel to the short sides of the trays, the chains of each conveyor running around end sprockets with horizontal axes, rectilinear branches of the chains being controlled by rectilinear guides which leave free one side of each chain, to which are fixed carriages spaced apart with the same distance between centers as that found between two spacers located on a short side of a tray, the carriages being provided with rollers which, as the carriages pass along a lower branch of the conveyor, run on a rectilinear fixed guide, and the carriages having levers pivoted parallel to the chains, flat ends of these levers, shaped into horizontal hooks, projecting towards the stacks of trays, above the plan dimensions of the stacks and with the opening of the hooks orientated in the direction of translation of the trays, while the opposite end of each of the levers carries a roller which as it passes along the rectilinear branches of the conveyor, interacts with rectilinear guides, the lower of which is grooved, double-acting, and is connected to the elevating and lowering system, for lowering and elevating, the hook-shaped ends of the levers, respectively, the hook-shaped levers gripping the upper tray of the stack with the ascending movement as the hook-shaped levers pass along the lower branch of the conveyor, by upper projecting parts of corresponding spacers, under heads of the respective spacer, after which the levers rotate to raise the gripped tray, to space the gripped tray apart from the underlying tray and to enable the gripped tray to be translated, while on completion of the translation, the levers rotate in the opposite direction, to lower the translated tray and deposit the tray on the underlying tray, after which the conveyor reverses movement to retract the hook-shaped levers, to bring the hook-shaped levers to a position in which the hook-shaped levers do not interfere with the spacers of the upper trays of the stacks.

29. A vertical kiln comprising a drying chamber having two or more vertical and adjacent stacks of horizontal trays which are made to rise by steps in one stack and then to descend by steps in the next stack via an elevating and lowering system, and which are moved along horizontal translatory paths by a lower translation device for the transfer from the top of one stack to that of the adjacent stack and for the transfer from the end of the last stack to the start of the first stack, where stations for unloading and loading articles from and into the trays operate in operable positions, the trays being arranged with vertical spacers so that the trays can be stacked on top of each other with sufficient spacing between them, and can be raised and lowered in the adjacent stacks by the elevating and lowering system which operates on respective bottom trays of the stacks, which picks up and deposits the trays on the lower translation device at an appropriate time, a lower device of the elevating and lowering system transferring an empty tray from a last stack to a first stack of the kiln, the bottom tray being held at a given height, above the lower translation device, by grippers which are activated and disabled in step with the elevating and lowering system, wherein the translation device provides a path for at least a limited number of trays to carry out an annular movement along a short path of a short cycle as compared with a normal path of a normal cycle whereby the limited number of trays are raised to pass into the loading station, and then raised by one or more steps and then translated towards a final stack where the trays descend to pass into the unloading station and then descend and are translated back into a first stack, under the loading station, for the repetition of the short cycle; and an auxiliary means for raising and holding trays not included in the short cycle, the auxiliary means having auxiliary conveyors for translating the trays not included in the short cycle from the first stack with an ascending movement to the last stack with a descending movement.

30. The vertical kiln according to claim 29, wherein the auxiliary means comprises forks fixed to uprights of a frame of the kiln with the interposition of a vertical guide and sliding block unit connected to a raising and lowering actuator.

31. The vertical kiln according to claim 29, wherein auxiliary conveyors provide for movement towards and away from the stacks of trays, wherein in a normal operating cycle of the kiln, the hook-shaped levers of the auxiliary conveyors do not interfere with normal movement of the trays.

32. The vertical kiln according to claim 31, wherein the auxiliary conveyors can be used to translate the trays between the tops of the stacks when oscillating levers of the auxiliary conveyors act in cavities of frames of the trays or on bases of the trays.

33. The vertical kiln according to claim 29, wherein the auxiliary conveyors comprise rectilinear conveyors parallel to upper conveyors, the rectilinear conveyors having chains running around sprockets with vertical axes and with teeth, the rectilinear conveyors can carry out translation of the trays by pushing the trays, rails being provided under active branches of the upper conveyor and rectilinear conveyor and parallel to the upper conveyor and the rectilinear conveyor, the rails being fixed to oscillating levers and connected to actuators which hold the rails in a retracted position in which the rails do not interfere with the trays, but which can translate the rails and insert the rails under the tray or trays to be translated so that the rails bear on these trays and raise the trays in the appropriate way.

34. The vertical kiln according to claim 28, further comprising rectilinear conveyors with movable rails which can be used in place of the horizontal chain conveyors.

35. The vertical kiln according to claim 33, wherein the auxiliary means can be made in sections with independent movements such that the auxiliary means can provide the translation of the trays between lower parts of intermediate stacks of a kiln having more than two adjacent stacks of trays, when the kiln is operating with a normal cycle.

* * * * *